US006617966B2

(12) United States Patent
Takahashi

(10) Patent No.: US 6,617,966 B2
(45) Date of Patent: Sep. 9, 2003

(54) COMPOUND ACOUSTIC ACTUATOR DRIVE CIRCUIT AND PORTABLE INFORMATION TERMINAL

(75) Inventor: Chiemi Takahashi, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/972,923

(22) Filed: Oct. 10, 2001

(65) Prior Publication Data

US 2002/0044046 A1 Apr. 18, 2002

(30) Foreign Application Priority Data

Oct. 12, 2000 (JP) ..... 2000-312176

(51) Int. Cl.[7] ..... N01N 37/46

(52) U.S. Cl. ..... 340/384.1; 340/384.6; 340/384.72; 340/384.73; 381/61; 381/62; 381/63

(58) Field of Search ..... 340/384.1, 384.6, 340/384.72, 384.73; 381/61, 62, 63; 455/567

(56) References Cited

U.S. PATENT DOCUMENTS

| | | | | |
|---|---|---|---|---|
| 3,889,166 A | * | 6/1975 | Scurlock | 318/116 |
| 5,596,311 A | * | 1/1997 | Bess et al. | 340/384.7 |
| 6,180,863 B1 | | 1/2001 | Tamura | |
| 6,208,237 B1 | | 3/2001 | Saiki et al. | 340/388.1 |

FOREIGN PATENT DOCUMENTS

| | | |
|---|---|---|
| EP | 1 045 613 A2 | 10/2000 |
| EP | 1 053 796 A1 | 11/2000 |
| JP | 57-185796 | 11/1982 |
| JP | 2-116359 | 5/1990 |
| JP | 10-258253 A | 9/1998 |
| JP | 2-963917 | 8/1999 |
| JP | 2963917 | 8/1999 |
| JP | 11-296174 | 10/1999 |
| JP | 11-327560 | 11/1999 |
| JP | 2000-99009 | 4/2000 |
| WO | WO 99/34934 A1 | 7/1999 |

* cited by examiner

*Primary Examiner*—Daniel J. Wu
*Assistant Examiner*—Tai T. Nguyen
(74) *Attorney, Agent, or Firm*—Foley & Lardner

(57) ABSTRACT

In a signal generation circuit for a compound acoustic actuator that generates a sound and a vibration in response to a frequency of a signal input to the compound acoustic actuator, the signal generation circuit comprising a plurality of signal data stored in a memory to generate a plurality of signals having mutually different frequencies, the plurality of signals at least including a signal, a frequency of which is equal to a resonant frequency causing the compound acoustic actuator to generate the vibration, a synthesizing means to synthesize a plurality of drive signals in accordance with the plurality of signal data so as to cause the compound acoustic actuator to generate the vibration, and a sweeping means to sweep the plurality of drive signals, repeatedly.

8 Claims, 10 Drawing Sheets

DRIVING WAVEFORM WITH A SWEEP WIDTH OF 2 HZ
(GENERATED BY JOINING 1 CYCLE EACH OF SINE WAVEFORMS FROM A FREQUENCY OF fo TO THE FREQUENCY fo−2 AT 1-HZ INTERVALS)

DRIVING WAVEFORM WITH A SWEEP WIDTH OF 2 HZ
(GENERATED BY JOINING 1 CYCLE EACH OF SINE WAVEFORMS FROM A FREQUENCY OF fo TO THE FREQUENCY fo−3 AT 1-HZ INTERVALS)

WAVEFORM FORMED BY JOINING 130, 131 AND 132-HZ
WAVEFORMS AT THE CENTER OF AMPLITUDE

WAVEFORM FORMED BY JOINING 130, 131 AND 132-HZ
WAVEFORMS AT POSITIONS OFFSET FROM THE CENTER OF AMPLITUDE

COMPOUND ACOUSTIC ACTUATOR DRIVE CIRCUIT AND PORTABLE INFORMATION TERMINAL

BACKGROUND OF THE INVENTION

1. Field of the Invention

The present invention relates to a compound acoustic actuator drive circuit suitable for use in a portable information terminal having variations in the vibration resonant frequency of a compound acoustic actuator.

2. Related Art

A compound acoustic actuator is used to generate vibration and sound, making use of the principle of a dynamic speaker, and are used in portable information terminals such as cellular phones to generate a sound or vibration when a call is received. A compound acoustic actuator has vibration resonant frequencies corresponding to a sound and to a vibration. In general, when a signal having a frequency equal to the lower resonant frequency is input, the compound acoustic actuator operates as a vibrating body, and when a signal having a frequency equal to the higher frequency is input, the compound acoustic actuator operates as a sound generator, in either case the vibration or sound notifying the user of the portable information terminal of the receipt of a call.

FIG. 10 of the accompanying drawings shows the general construction of a compound acoustic actuator, in which when an electrical signal at an audible frequency is input to a coil 34, a driving force is generated between the coil 34 and the magnetic circuit 33, so that a sound is generated by the vibration of a diaphragm 35. If the frequency of the electrical signal input to the coil 34 coincides with the resonant frequency of the mechanical vibrating system formed by the magnetic circuit 33 and a suspension spring 32, the magnetic circuit 33 vibrates, and the vibration is transmitted to a case 31 via the suspension spring 32.

FIG. 11 shows the measured values of the vibration characteristics of two compound acoustic actuators, A and B, at a nominal frequency of 132 Hz. From these measurement results, it can be seen that there is a dispersion of approximately 1 Hz in the vibration resonant frequency $R_{0Real}$ with respect to the nominal value. The Q being a high value, there is a great decrease in the vibration amplitude at frequencies which are not the vibration resonant frequency $f_{0Real}$ thereof (in this case $f_{OA}$ and $f_{OB}$).

For example, it is possible to obtain a maximum vibration amplitude (acceleration) as indicated in the vibration characteristics of the compound acoustic actuator A in the case in which the resonant frequency $f_0$=132 Hz is input to the compound acoustic actuator A. However, the vibration amplitude obtained for the case in which the resonant frequency $f_0$=132 Hz is input to the compound acoustic actuator B drops to approximately 76% of the maximum value of the compound acoustic actuator B. In a compound acoustic actuator, therefore, in order to achieve a sufficient amount of vibration, it is necessary to apply a signal coinciding in frequency with the vibration resonant frequency of the compound acoustic actuator.

As shown in FIG. 12, therefore, in a configuration in which an electrical signal of a pre-established frequency is generated by a signal generator 1 and amplified by an amplifier 2, the amplified signal being input to the compound acoustic actuator 3 so as to generate either a sound or a vibration, there is the problem of a large dispersion in the amount of vibration. To compensate for this problem, a transducer is proposed as disclosed in the Japanese Patent No.2963917, in which an individual vibration resonant frequency $R_{0Real}$ is detected, and the frequency of the drive signal is automatically adjusted to this detected frequency $R_{0Real}$.

This conventional technology, however, is accompanied by the following problems. Specifically, there is an increase in cost that is incurred because of the complexity of an automatic tracking circuit that must be provided so as to search for the vibration resonant frequency $f_{0Real}$ for each individual device.

Accordingly, it is an object of the present invention to provide a driving waveform that suppresses a reduction in the amount of vibration caused by dispersion in the vibration resonant frequency of a compound acoustic actuator, and further to provide a drive circuit of simple configuration for generating this driving waveform.

SUMMARY OF THE INVENTION

In order to achieve the above-noted objects, the present invention adopts the following technical constitution.

Specifically, a first aspect of the present invention is a signal generation circuit for a compound acoustic actuator that generates a sound and a vibration in response to a frequency of a signal input to the compound acoustic actuator, the signal generation circuit comprising: a plurality of signal data stored in a memory to generate a plurality of signals having mutually different frequencies, the plurality of signals at least including a signal, a frequency of which is equal to a resonant frequency causing the compound acoustic actuator to generate the vibration, a synthesizing means to synthesize a plurality of drive signals in accordance with the plurality of signal data so as to cause the compound acoustic actuator to generate the vibration, and a sweeping means to sweep the plurality of drive signals, repeatedly.

In the second aspect of the present invention, the drive signal is a sine wave.

In the third aspect of the present invention, the drive signal is a wave except for a sine wave.

In the fourth aspect of the present invention, the synthesizing means synthesizes by joining the plurality of sine waveforms at a center of an amplitude thereof.

The fifth aspect of the present invention is a signal generation circuit for a compound acoustic actuator that generates a sound and a vibration in response to a frequency of a signal input to the compound acoustic actuator, the signal generation circuit comprising: a variable voltage generator to generate a variable voltage, a voltage controlled oscillator controlled by an output of the variable voltage generator and generating a drive signal so as to drive the compound acoustic actuator, a frequency of the drive signal including a resonant frequency causing the compound acoustic actuator to generate the vibration, and a sweeping means to cause the variable voltage generator to generate the variable voltage, repeatedly.

More specifically, the present invention relates to a drive circuit for a compound acoustic actuator, which is mounted in a portable information terminal and which performs notification of a received call by means of vibration, this circuit generating a driving wave that sweeps repeatedly over an arbitrary frequency range, which encompasses the vibration resonant frequency, by using a PCM (pulse code modulation) sound source or the like as the drive circuit.

By adopting the above-noted configuration, it is possible to suppress a reduction in the maximum amount of vibration caused by dispersion in the vibration resonant frequency caused at the time of mounting the compound acoustic actuator. Additionally, by using as the driving waveform a plurality of sine waveforms smoothly joined at the center of the amplitude thereof, with a prescribed frequency interval and period, it is possible to suppress the generation of harmonics, thereby preventing the generation of an abnormal sound.

BRIEF DESCRIPTION OF THE DRAWINGS

FIG. 1(*b*) is a block diagram showing the PCM sound source circuit of the present invention.

DETAILED DESCRIPTION OF THE PREFERRED EMBODIMENTS

Embodiments of the present invention are described in detail below, with references made to relevant accompanying drawings.

First Embodiment

Figure 1A:
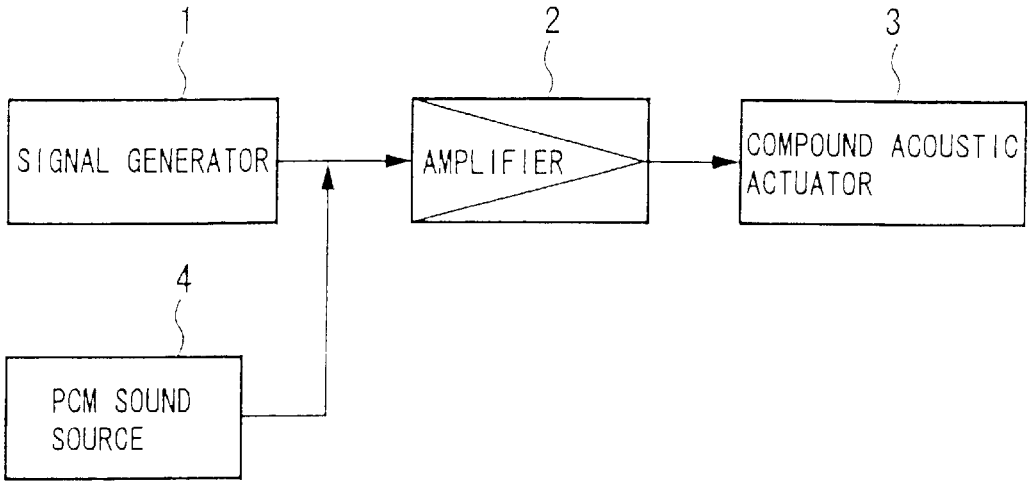
FIG. 1(*a*) is a block diagram showing the configuration of the present invention.
Figure 1B:
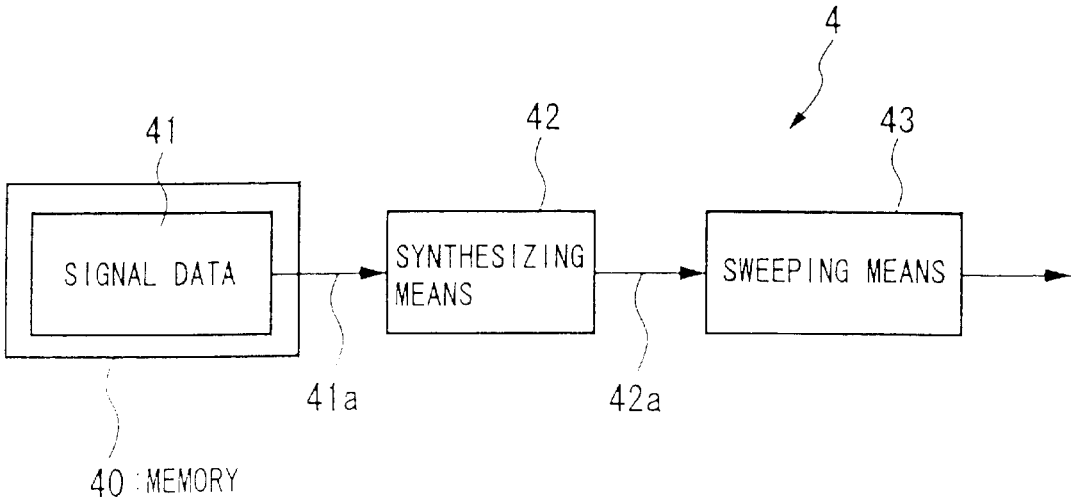

Specifically, FIG. 1 is a block diagram showing the configuration of the first embodiment of the present invention. In the first embodiment, a signal generator 1 generates audible signal. At a PCM sound source (vibration signal generator) 4, a plurality of sine waveforms with a prescribed number of periods at prescribed frequency intervals are stored beforehand in a memory, and these are joined together and output. The signal generator 1 and the PCM sound source 4 form the drive signal circuit. An amplifier 2 amplifies the drive signal from the signal generator 1 and the PCM sound source 4, and output the amplified signal to a compound acoustic actuator 3. The compound acoustic actuator 3 generates a sound in accordance with the output from the signal generator 1 and generates a vibration based on the output from the PCM sound source 4.

Accordingly, in this embodiment of the present invention, as a call notification operation when a call is received by a portable information terminal, the signal generator 1 operates in the case of notification by an audible sound, and the PCM sound source 4 operates in the case of notification by a vibration.

The operation of waveform generation by the PCM sound source 4 in the above-noted embodiment is described below, with references made to FIG. 2 through FIG. 4.

In this embodiment, the PCM sound source 4 has a plurality of sine waveforms with a prescribed number of periods at prescribed frequency intervals, such as vibration resonant frequency $f_0$, and up to a frequency nHz lower than the frequency $f_0$ near the vibration resonant frequency $f_0$ of the compound acoustic actuator 3, stored in memory beforehand. When these signals are output, these signals are joined sequentially from the low frequency toward the high frequency and the high frequency toward the low frequency, and output.

Figure 2:
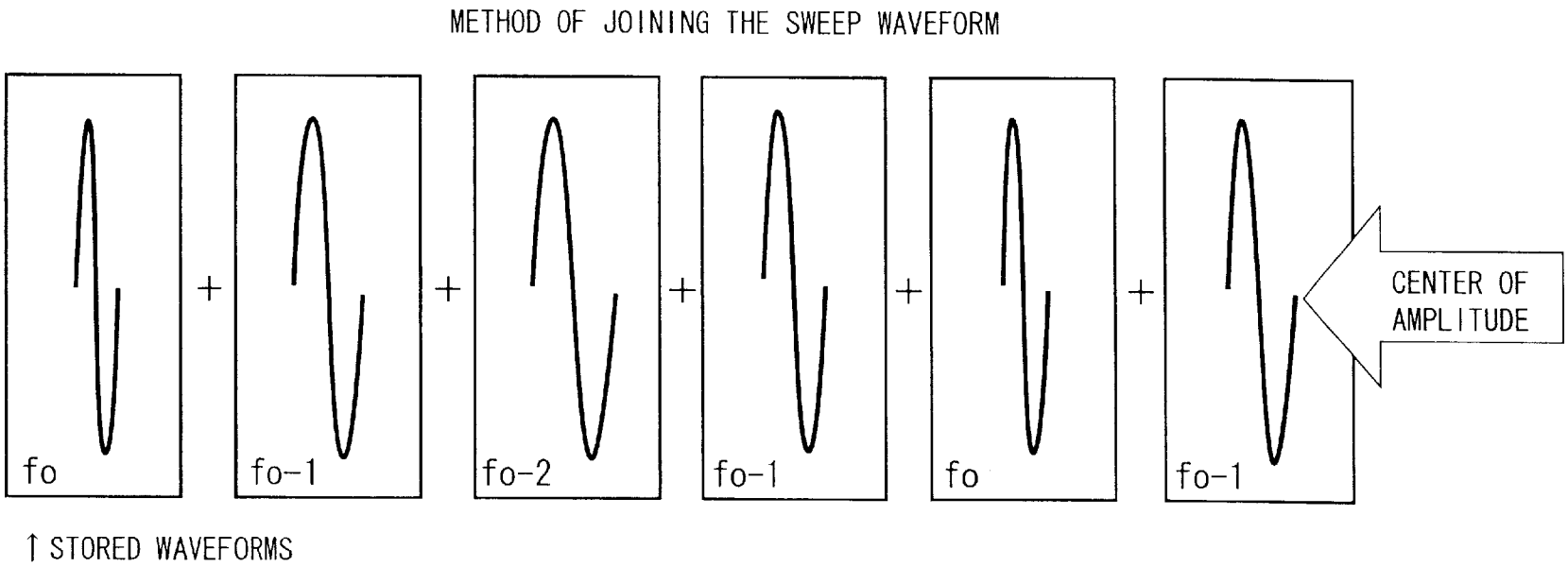
FIG. 2 is a drawing illustrating the method of joining waveforms.
Figure 3:
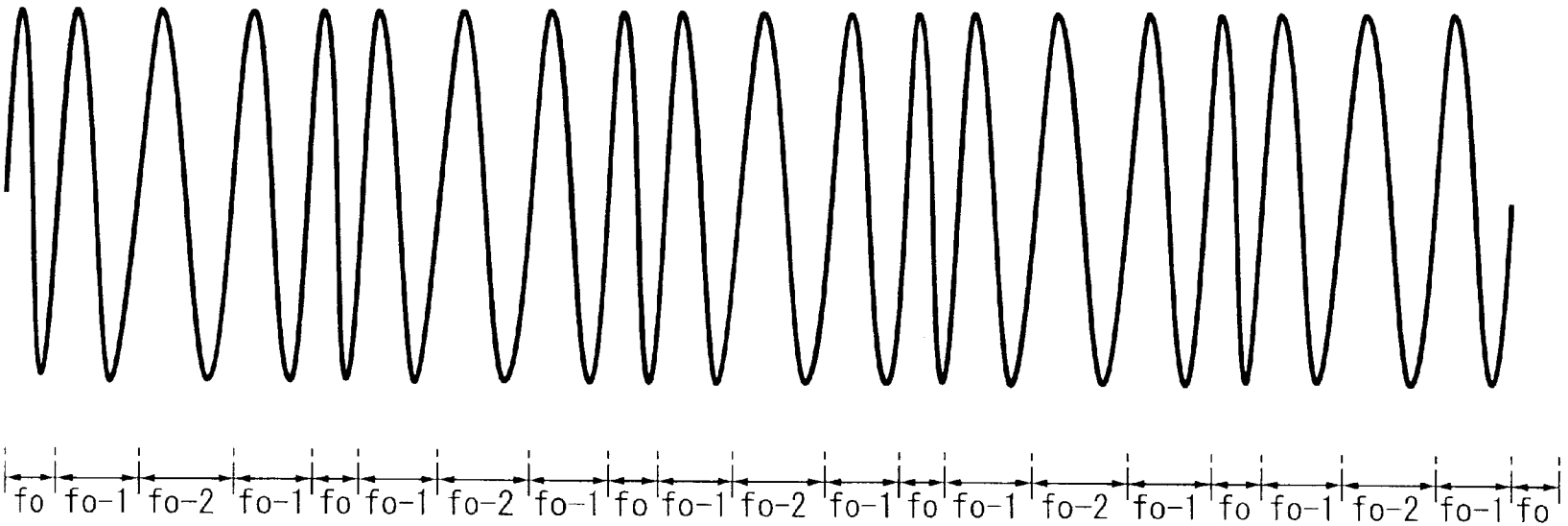
FIG. 3 is a drawing showing a driving waveform.

The above situation is illustrated by FIG. 2 and FIG. 3 for the case in which n=2, the frequency spacing is 1 Hz, and the number of periods is 1 period. In this case, the waveforms stored in the memory of the PCM sound source 4, as shown In FIG. 2, are the sine waveforms having the frequencies $f_0$, $f_0-1$, and $f_0-2$ Hz. Upon output, as shown in FIG. 3, the joining operation is performed by scanning from $f_0$, to $f_0-2$ Hz one period at a time, in the sequence $f_0$, ($f_0-1$), ($f_0-2$), ($f_0-1$), ($f_0$), ($f_0-1$), ($f_0-2$), ($f_0-1$), ($f_0$), ($f_0-1$) ($f_0-2$), ($f_0-1$), ($f_0$), and so on, between $f_0$ and $f_0-2$ Hz, at 1-Hz intervals.

Figure 4:
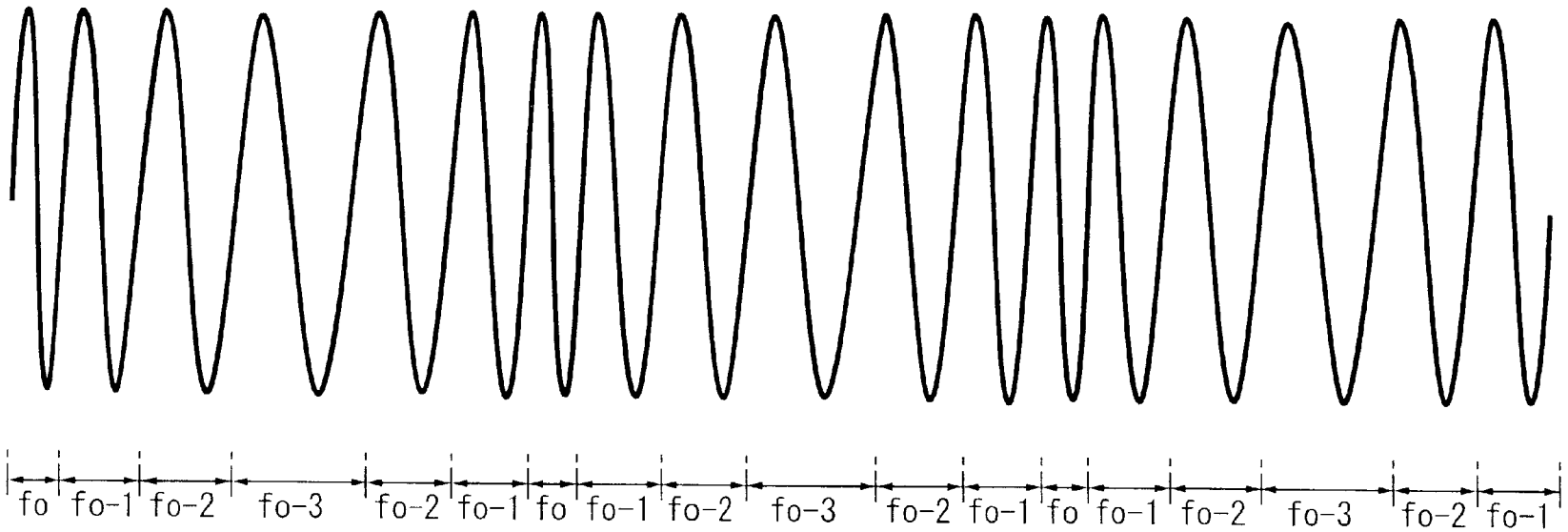
FIG. 4 is a drawing showing a driving waveform.

FIG. 4 illustrates a similar example, in which n=3, the frequency spacing is 1 Hz, and the number of periods is 1 period. In his example, a scan is made one period at a time, from $f_0$ to $f_0-3$ Hz, at 1-Hz intervals.

Figure 5:
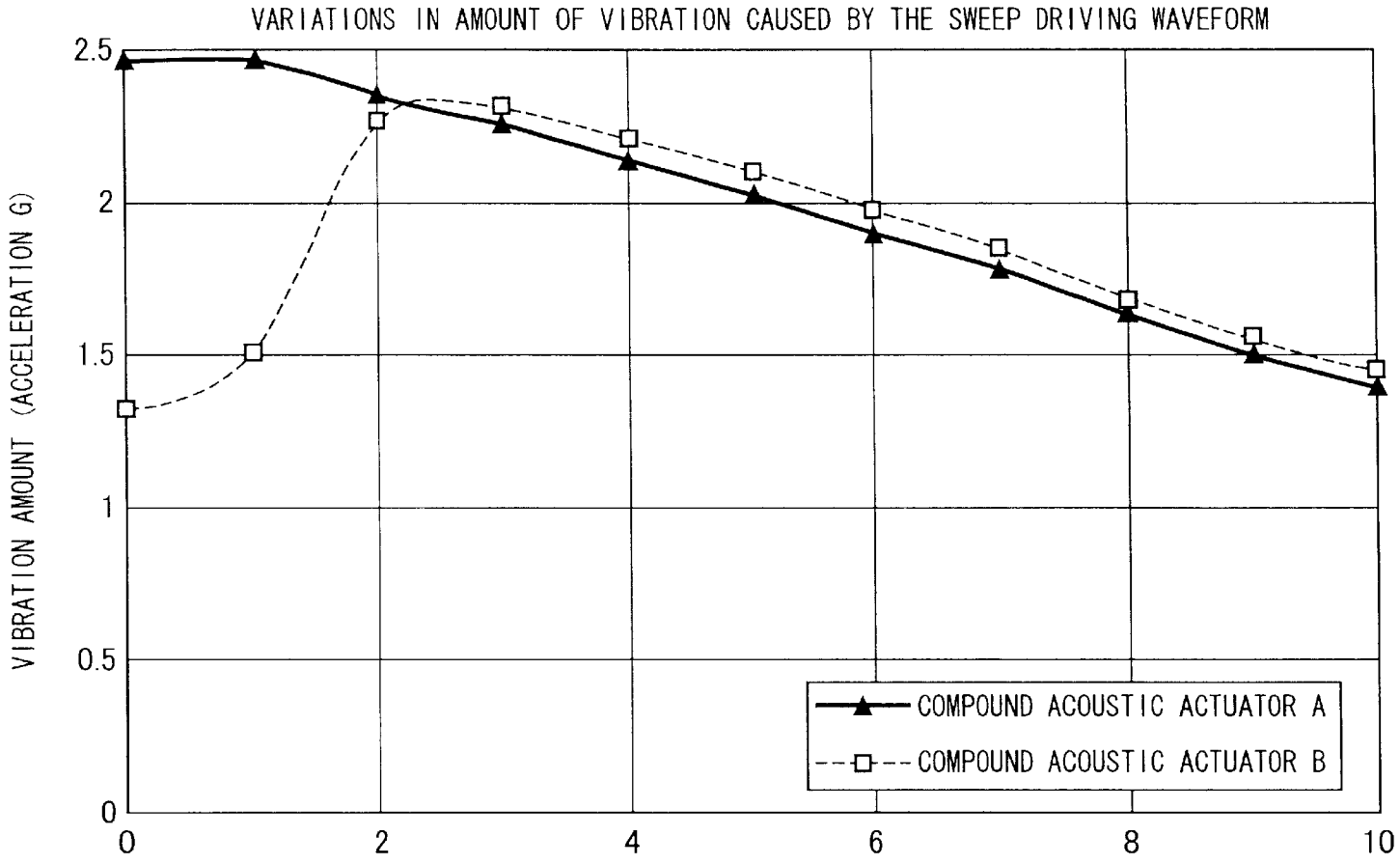
FIG. 5 is a drawing showing the variation in the amount of vibration caused by dispersion in the vibration resonant frequency.

In the case in which a nominal vibration resonant frequency $f_0$ of the compound acoustic actuator is 132 Hz, and the actual vibration resonant frequency $R_{0Real}$ of the compound acoustic actuator is 131 Hz, the compound acoustic actuator receives a signal having the actual vibration resonant frequency $R_{0Real}$ of 131 Hz during scanning, so that it is possible to obtain the maximum vibration. Therefore, as shown in FIG. 5, it is possible to suppress the reduction in amount of vibration caused by dispersion of the vibration resonant frequency of the compound acoustic actuator.

In this embodiment of the present invention, the driving waveforms range is from the vibration resonant frequency $f_0$ to a frequency lower than the vibration resonant frequency $f_0$. The reason for this is that, as can be seen from the vibration characteristics of the compound acoustic actuator shown in FIG. 11, at frequencies lower than the frequency of $f_{0Real}$, as the frequency increases, there is a gradual decrease in the amount of vibration, whereas at frequencies higher than $f_{0Real}$ there is a sharp decrease in the amount of vibration. As a result, it is better to make the frequency scan from $f_{0Real}$ toward frequencies lower than $f_{0Real}$, so that a larger amount of vibration is achieved.

Figure 11:
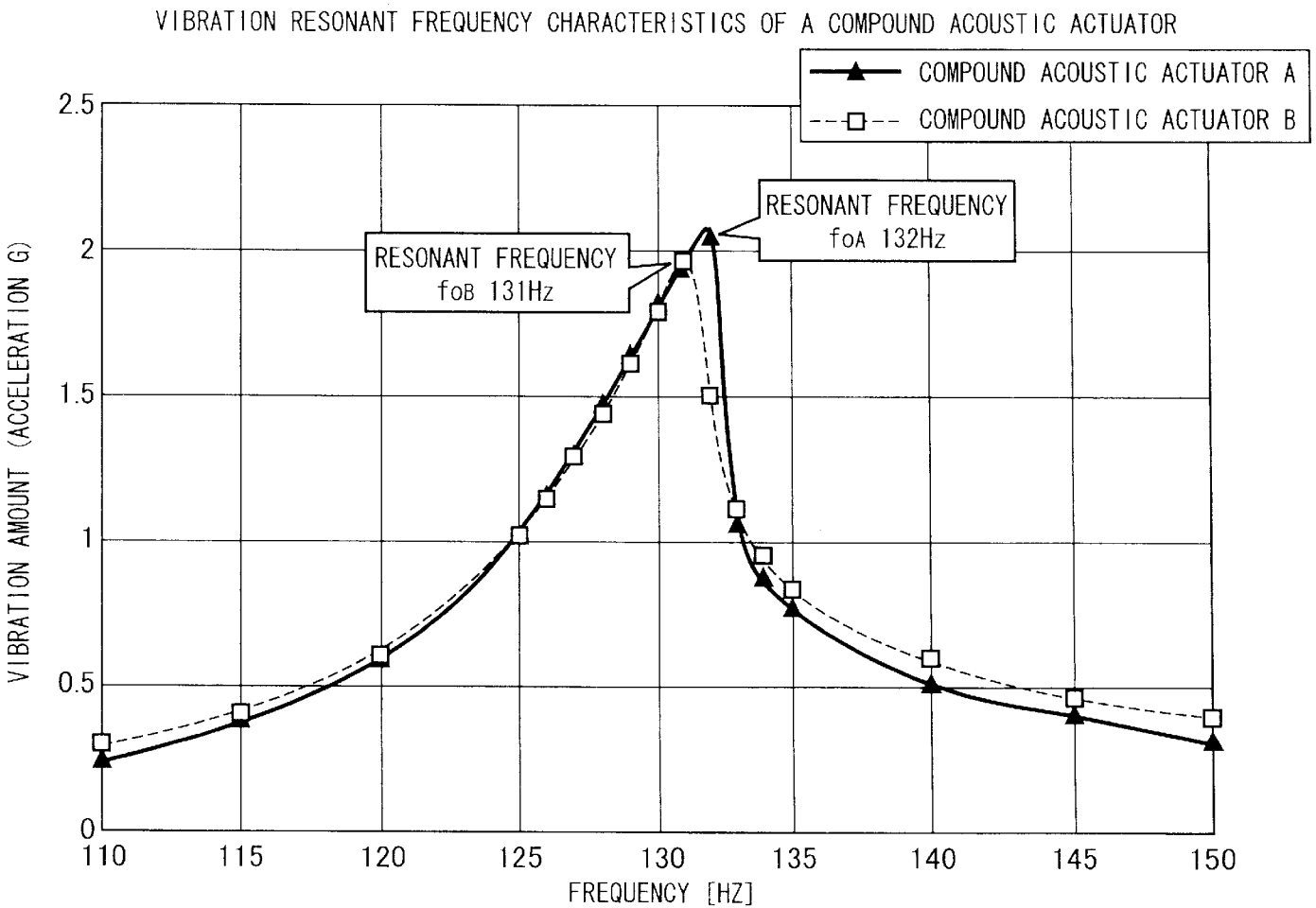
FIG. 11 PRIOR ART
FIG. 11 is a drawing showing the vibration frequency characteristics of compound acoustic actuators.
Figure 12:
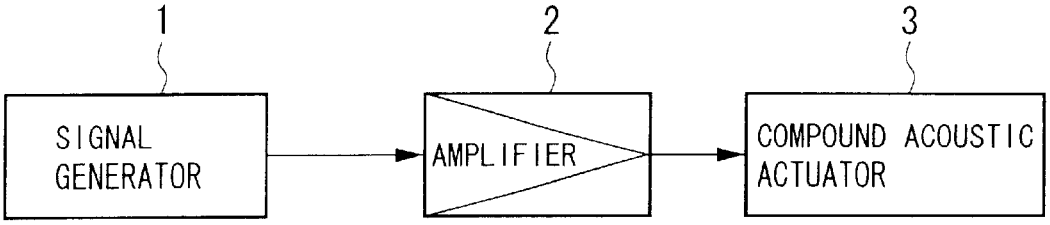
FIG. 12 PRIOR ART
FIG. 12 is a drawing showing a conventional drive circuit of a compound acoustic actuator.

Given the vibration characteristics shown in FIG. 11, the maximum value of the range of scanning the frequency is set to the vibration resonant frequency $f_0$ which is the nominal value. However, if a compound acoustic actuator having different vibration characteristics from the above-mentioned actuator is to be driven, the scanning range can be made arbitrarily, as long as the frequency range scanned includes the vibration resonant frequency $f_0$.

Figure 6:
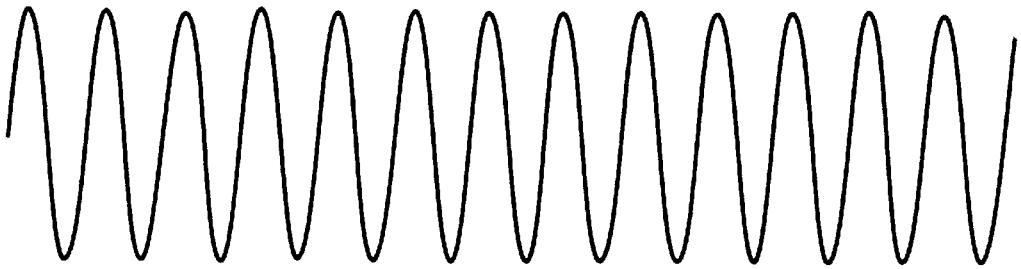
FIG. 6 is a drawing showing a driving waveform according to the present invention.

The waveforms are joined in the present invention as follows. In order to suppress harmonics, the switching control of the frequency, such as for example from $f_0$ to $f_{0-1}$ as shown in FIG. 2, is performed so that the waveform is switched to a waveform of a different frequency at a the center position of the sine waveform at which the amplitude thereof is 0, as shown in FIG. 2, thereby resulting in a smooth joining of the waveforms with prescribed number of period at prescribed frequency intervals, as shown in FIG. 6. In contrast to this, FIG. 7 shows the result of joining waveforms at positions offset from the center positions.

Figure 7:
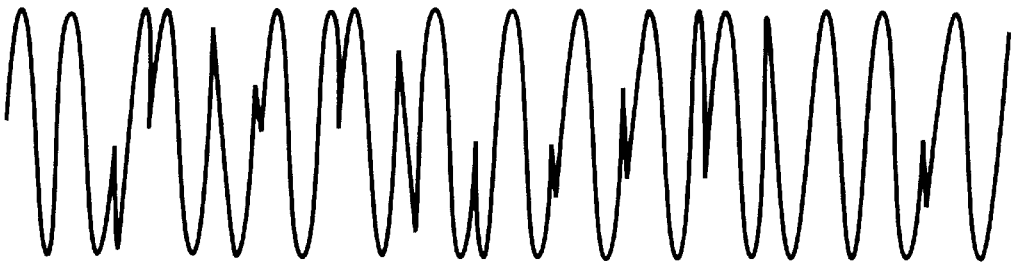
FIG. 7 is a drawing showing a driving waveform generated without consideration given to the joining points.
Figure 8:
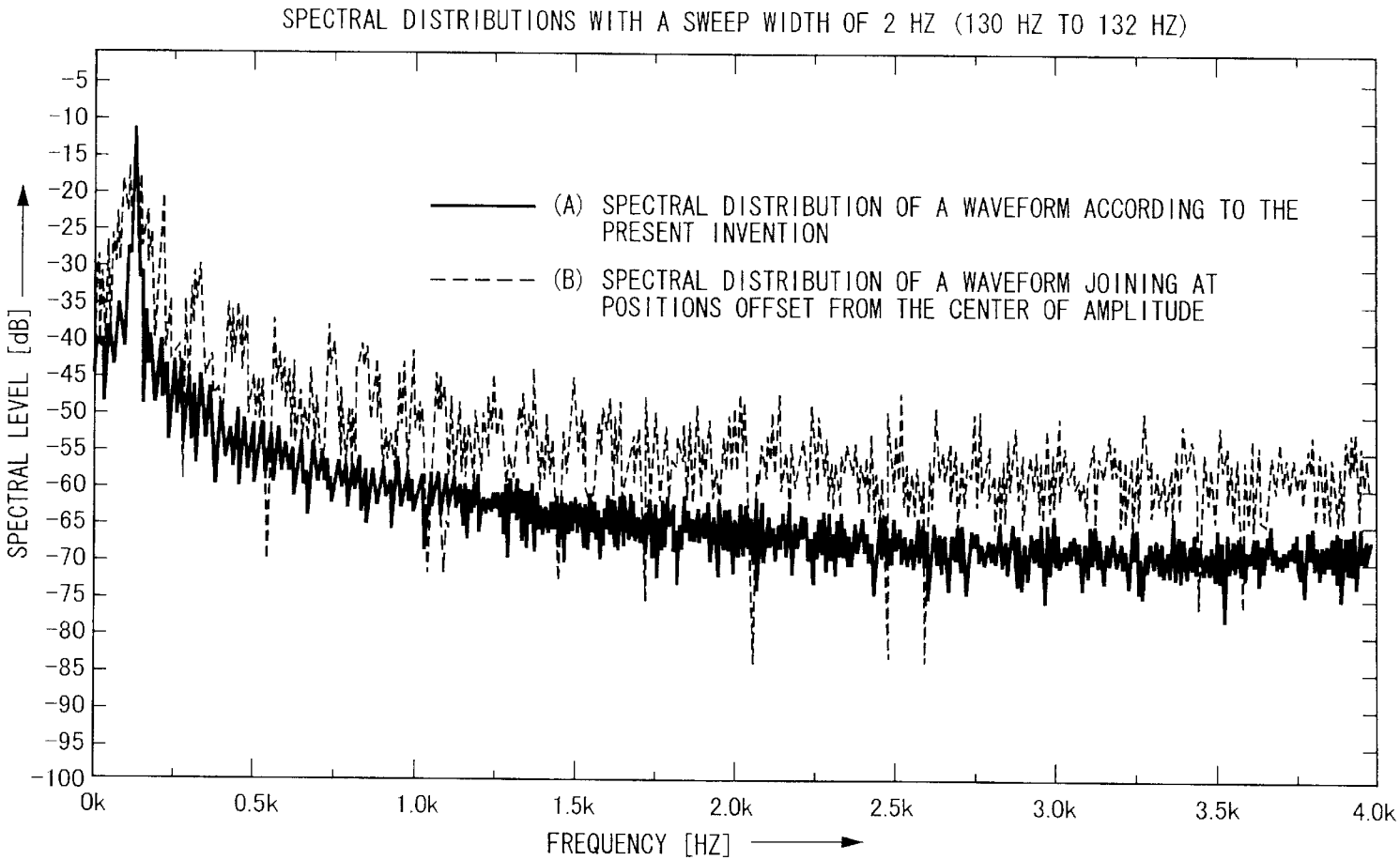
FIG. 8 is a drawing showing the spectral distributions of driving waveforms.

FIG. 8 shows the spectral distributions of the driving waveform in the present invention (FIG. 6) and the driving waveform in the case in which the joining points are not considered (FIG. 7). From these results, it can be seen that the waveform according to the present invention has a harmonic spectral level that is approximately 1 dB lower than that of a waveform in which the joining points are not considered. Because inputting a waveform having harmonic components to the compound acoustic actuator 3 causes the generation of an abnormal sound, it is desirable to use a signal having a low harmonic level. The method of joining the waveforms according to the present invention, therefore, prevents the generation of such abnormal sounds.

In this manner, by using a digitally controllable PCM sound source 4, it is not necessary to have a complex circuit, and it is possible to easily generate a driving waveform by pre-storing a plurality of sine waveforms with a prescribed number of periods at prescribed frequency intervals and merely switching between them at the center value position of each sine waveforms.

Although the foregoing embodiment of the present invention is described for the case in which the waveforms were joined at the center positions for each cycle, It will be understood that there is no restriction in the present invention to this arrangement, and that it is alternately possible to join the waveforms at other positions, as long as the joining maintains the smoothness of the joined waveform, in accordance with the parameters of the generator.

As described above, the first embodiment of the present invention is a signal generation circuit for a compound acoustic actuator that generates a sound and a vibration in response to a frequency of a signal input to the compound acoustic actuator, the signal generation circuit 4 comprising: a plurality of signal data 41 stored in a memory 40 to generate a plurality of signals 41*a* having mutually different frequencies, the plurality of signals 41*a* at least including a signal, a frequency of which is equal to a resonant frequency $f_0$ causing the compound acoustic actuator 3 to generate the vibration, a synthesizing means 42 to synthesize a plurality of drive signals 42*a* in accordance with the plurality of signal data 41 so as to cause the compound acoustic actuator to generate the vibration, and a sweeping means 43 to sweep the plurality of drive signals, repeatedly.

Second Embodiment

Figure 9:
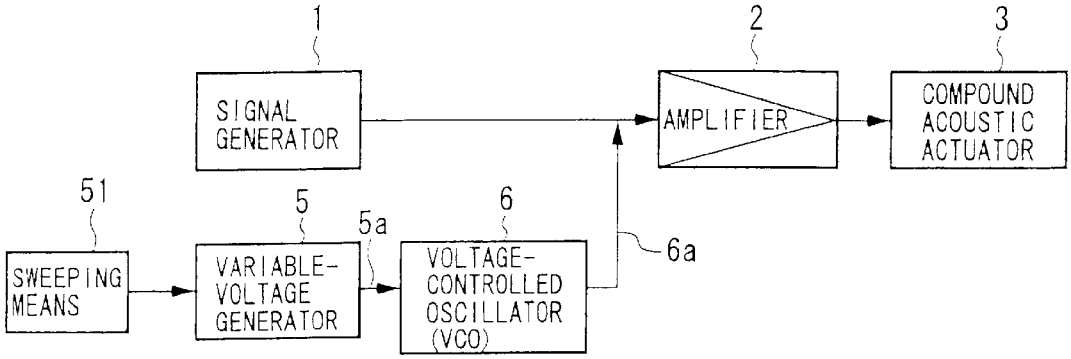
FIG. 9 is block diagram showing the configuration of another embodiment of the present invention.
Figure 10:
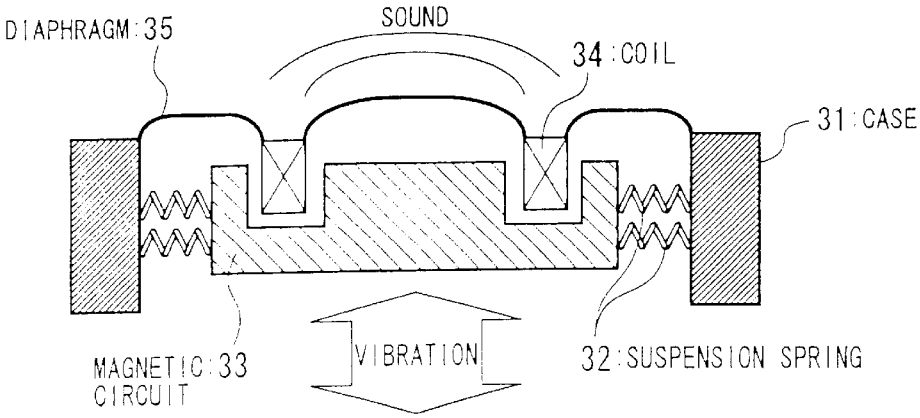
FIG. 10 PRIOR ART
FIG. 10 is a drawing showing the general construction of a compound acoustic actuator.

The second embodiment of the present invention is shown in FIG. 9. In this embodiment, a variable-voltage generator 5 and a voltage controlled oscillator 6 are provided in place of the PCM sound source 4 of FIG. 1. In contrast to the use of the PCM sound source 4, in which a plurality of sine waveforms with a prescribed number of cycles at prescribed frequency intervals are switched, in the second embodiment, the variable-voltage generator 5 is used to control the oscillation frequency by varying a control voltage of the voltage-controlled oscillator 6, thereby generating the driving waveform. In this embodiment, when generating a driving waveform the frequency sweeping range is an arbitrary frequency band including the actual vibration resonant frequency $f_0$, this range being swept continuously.

As described above, the second embodiment of the present invention is a signal generation circuit for a compound acoustic actuator that generates a sound and a vibration in response to a frequency of a signal input to the compound acoustic actuator, the signal generation circuit comprising: a variable voltage generator 5 to generate a variable voltage 5*a*, a voltage controlled oscillator 6 controlled by an output 5*a* of the variable voltage generator 5 and generating a drive signal 6*a* so as to drive the compound acoustic actuator 3, a frequency of the drive signal 6*a* including a resonant frequency $f_0$ causing the compound acoustic actuator 3 to generate the vibration, and a sweeping means 51 to cause the variable voltage generator 5 to generate the variable voltage 5*a*, repeatedly.

As can be understood from the detailed description presented above, a first effect achieved by the present invention is that of preventing a reduction in the amount of vibration produced as a result of dispersion of the vibration resonant frequency $f_{0Real}$ of the compound acoustic actuator.

A second effect achieved by the present invention is that of suppressing the level of harmonic components that are included in the driving waveform formed by joining a plurality of sine waveforms having different frequencies, thereby preventing the generation of an abnormal sound from the compound acoustic actuator.

A third effect achieved by the present invention is that of controlling the waveform using a PCM sound source, thereby simplifying the circuit in comparison to the conventional case in which a tracking circuit must be provided.

What is claimed is:

1. A signal generation circuit for a compound acoustic actuator that generates a sound and a vibration in response to a frequency of a signal input to said compound acoustic actuator, said signal generation circuit comprising:

a plurality of signal data stored in a memory to generate a plurality of signals having mutually different frequencies, said plurality of signals at least including a signal, a frequency of which is equal to a resonant frequency causing said compound acoustic actuator to generate said vibration, a synthesizing means to synthesize a plurality of drive signals in accordance with said plurality of signal data so as to cause said compound acoustic actuator to generate said vibration, and a sweeping means to sweep said plurality of drive signals, repeatedly.

2. A signal generation circuit for a compound acoustic actuator according to claim 1, wherein said drive signal is a sine wave.

3. A signal generation circuit for a compound acoustic actuator according to claim 1, wherein said drive signal is a wave except for a sine wave.

4. A signal generation circuit for a compound acoustic actuator according to claim 2, wherein said synthesizing means synthesizes by joining said plurality of sine waveforms at a center of an amplitude thereof.

5. A portable information terminal having a signal generation circuit for a compound acoustic actuator that generates a sound and a vibration in response to a frequency of a signal input to said compound acoustic actuator, said signal generation circuit comprising:

a plurality of signal data stored in a memory to generate a plurality of signals having mutually different frequencies, said plurality of signals at least including a signal, a frequency of which is equal to a resonant frequency causing said compound acoustic actuator to generate said vibration, a synthesizing means to synthesize a plurality of drive signals in accordance with said plurality of signal data so as to cause said compound acoustic actuator to generate said vibration, and a sweeping means to sweep said plurality of drive signals, repeatedly.

6. A portable information terminal according to claim 5, wherein said drive signal is a sine wave.

7. A portable information terminal according to claim 5, wherein said drive signal is a wave except a sine wave.

8. A portable information terminal according to claim 6, wherein said synthesizing means synthesizes by joins said plurality of sine waveforms at a center of an amplitude thereof.

* * * * *